US009109363B2

(12) United States Patent
Grau

(10) Patent No.: US 9,109,363 B2
(45) Date of Patent: Aug. 18, 2015

(54) INTERLOCKING PANEL SIDING

(71) Applicant: William Grau, Geneva, IL (US)

(72) Inventor: William Grau, Geneva, IL (US)

( * ) Notice: Subject to any disclaimer, the term of this patent is extended or adjusted under 35 U.S.C. 154(b) by 0 days.

(21) Appl. No.: 13/757,729

(22) Filed: Feb. 1, 2013

(65) Prior Publication Data

US 2013/0199121 A1 Aug. 8, 2013

Related U.S. Application Data

(60) Provisional application No. 61/594,312, filed on Feb. 2, 2012.

(51) Int. Cl.
*E04D 1/28* (2006.01)
*E04C 2/30* (2006.01)

(52) U.S. Cl.
CPC ..... *E04C 2/30* (2013.01)

(58) Field of Classification Search
CPC .... E04F 13/0864; E04F 13/007; C04B 41/52; E04D 1/28; E04D 1/34
USPC ..... 52/541, 539, 519, 520, 309.11, 309.12
See application file for complete search history.

(56) References Cited

U.S. PATENT DOCUMENTS

| | | | | |
|---|---|---|---|---|
| 492,736 | A * | 2/1893 | Shull | 52/539 |
| 4,096,011 | A | 6/1978 | Sanders et al. | |
| 4,955,169 | A * | 9/1990 | Shisko | 52/536 |
| 5,298,214 | A | 3/1994 | Morrow et al. | |
| 5,789,477 | A | 8/1998 | Nosker et al. | |
| 5,916,932 | A | 6/1999 | Nosker et al. | |
| 5,951,940 | A | 9/1999 | Nosker et al. | |
| 6,191,228 | B1 | 2/2001 | Nosker et al. | |
| 6,298,626 | B2 * | 10/2001 | Rudden | 52/520 |
| 6,588,166 | B2 | 7/2003 | Martensson et al. | |
| 6,606,834 | B2 | 8/2003 | Martensson et al. | |
| 6,647,690 | B1 | 11/2003 | Martensson | |
| 6,808,785 | B1 | 10/2004 | Friedman et al. | |
| 6,854,235 | B2 | 2/2005 | Martensson | |
| 7,131,242 | B2 | 11/2006 | Martensson et al. | |
| 7,351,462 | B2 | 4/2008 | Friedman et al. | |
| 7,712,277 | B2 * | 5/2010 | Swanson | 52/541 |
| 7,762,040 | B2 | 7/2010 | Wilson et al. | |
| 7,765,763 | B2 | 8/2010 | Teng et al. | |
| 7,795,329 | B2 | 9/2010 | Nosker et al. | |
| 8,091,313 | B2 * | 1/2012 | Wilson et al. | 52/534 |
| 2003/0046891 | A1 | 3/2003 | Colada et al. | |
| 2003/0056458 | A1 * | 3/2003 | Black et al. | 52/541 |
| 2004/0107663 | A1 | 6/2004 | Waggoner | |
| 2007/0193177 | A1 | 8/2007 | Wilson et al. | |
| 2009/0313934 | A1 | 12/2009 | Carlson | |

* cited by examiner

*Primary Examiner* — Jeanette E Chapman
*Assistant Examiner* — Daniel Kenny
(74) *Attorney, Agent, or Firm* — Richards Patent Law P.C.

(57) ABSTRACT

An interlocking panel system including: a pair of panels, each including: a front face including a fastener notch; a rear face; a top edge, wherein the top edge includes a top front edge that extends above a top rear edge; and a lower edge, wherein the lower edge includes a front edge that extends below a bottom middle edge and a bottom rear edge, further wherein the bottom rear edge extends below the bottom middle edge; wherein, when the lower edge of the first panel is placed onto the top edge of the second panel, the bottom front edge of the first panel covers the fastener notch of the second panel.

6 Claims, 11 Drawing Sheets

INTERLOCKING PANEL SIDING

BACKGROUND OF THE INVENTION

The present subject matter relates generally to interlocking siding. More specifically, the present invention relates to an interlocking siding design that provides an external profile though which there are no perforations exposed after installation.

Siding provides an exterior barrier for walls and surfaces in order to protect the under layers from the effects of weather and moisture. Siding can also contribute to the aesthetic value of a house or structure, by adding a tasteful color or texture to the surface. Aesthetic value also can affect the property value of a structure or building, so the appearance of the siding is important. Siding is usually affixed to the outside of a building in panels in an overlapping assembly. Since the siding is traditionally applied in segments, it allows for the expansion and contraction of the building materials that is caused by various temperatures and humidity. Siding can be composed of many different materials including but not limited to wood, vinyl, metal, cement, or plastic.

Certain kinds of siding can be very labor intensive to manufacture and install. Some siding is made of expensive materials, which increases the total cost of the installation and purchase of the siding. Installing siding can be labor intensive because it must be installed in such a way that seals the outside layer from the elements. Also, siding is only typically installed during moderate weather, thus limiting the possibility of installation in some regions with harsh winters.

During installation, constant attention must be given to the distance of overlap of the siding segments, and the placement, to make sure the segments are appropriately spaced. The placement of the siding is important to create a uniform pattern on the outer surface thus giving the attractive aesthetic appearance in addition to the functional barrier.

Accordingly, a need exists for an interlocking siding product and method as described and claimed herein.

BRIEF SUMMARY OF THE INVENTION

In order to meet the ever growing need to provide an interlocking siding that is easy to assemble, install and provides an effective barrier and is aesthetically appealing, the present subject matter discloses a siding with a unique structure. The siding panel includes an indicia for a fastener placement combined with a unique mating potion geometry. The top edge of the siding has a front face for facing outside towards the elements and a rear face for facing the internal structure. The panel includes a top front edge that extends above the top rear edge. The lower edge of the panel includes three sections adapted for mating to the top edge of an adjacent panel. The front face of the lower edge extends the lowest, the middle section is recessed, and the rear section falls between the lowest extension and the recessed portion. A barrier may be formed using identical panels, making installation easy and maintenance free.

When two or more panels are mated together, they form a barrier to moisture and other elements. In addition to forming a barrier and keeping out moisture, the mating mechanism facilitates a mistake-free assembly. When mated, the front face of the lower edge of an upper panel extends far enough down the front face of the lower panel to cover the indicia for fastener placement located on the front face of the lower panel. Therefore when assembled, all of the fasteners used to secure the panels to the internal structure will be hidden, thus providing an effective barrier that is visually pleasing. No evidence of the fasteners is left to be seen at an outward view, they will all be hidden underneath the overlapping structure of the siding.

The front face of the panel may include a fastener notch. The notch allows the fastener head to sit inside the body of the siding panel rather than protrude beyond the front face. Also, the notch provides indicia for fastener placement such that an installer may be assured the fasteners are properly located to be covered by the adjacent overlapping panel, thus making it easier to assemble and mistake proof.

In some embodiments the body of the interlocking siding may be made of recycled or waste materials. Recycled or waste materials may be cost effective and may also reduce placement in landfills, thus helping the environment. For example, the panels may be formed from a single or multilayer extrusion process. In a multilayer extrusion, the one or more inner layers may include recycled or waste products, while the outer layer may be from another material entirely.

In some embodiments the body and rear face of the interlocking siding panels may incorporate various patterns and cut outs to decrease the amount of material needed to create the siding. This decreased amount of material will keep the overall cost of materials down thus making the siding more affordable. Decreasing the amount of material will also lessen the weight of the siding and made the product more flexible, which will also make the installation easier.

The method of installation is simple and easy. The first piece to fit at the base of the structure may be a starter strip. The starter strip has a flat bottom and a two tier top face for mating with the bottom edge of the adjacent panel. After the starter strip is fixed where indicated, the installer may fit the first piece of panel siding onto the starter strip, the bottom edge of the panel overlapping and interlocking the top edge of the starter strip. Once the first panel is secured to the starter strip, it may be fastened into the structure where indicated. All subsequent siding panels will fit accordingly in a uniform pattern, using this same method without the need for measuring or use of a spacer to assure consistency, saving time and money. Since all of the siding panels are identical, it will be easy to stack the panels together without needing to differentiate between the panels. The starting strip and unvarying design of siding will allow for a mistake proof installation that can be accomplished by a non-expert.

In one example, an interlocking panel system includes: a first panel including: a front face including a fastener notch; a rear face; a top edge, wherein the top edge includes a top front edge that extends above a top rear edge; and a lower edge, wherein the lower edge includes a front edge that extends below a bottom middle edge and a bottom rear edge, further wherein the bottom rear edge extends below the bottom middle edge; and a second panel including: a front face including a fastener notch; a rear face; a top edge, wherein the top edge includes a top front edge that extends above a top rear edge; and a lower edge, wherein the lower edge includes a front edge that extends below a bottom middle edge and a bottom rear edge, further wherein the bottom rear edge extends below the bottom middle edge; wherein, when the lower edge of the first panel is placed onto the top edge of the second panel, the bottom front edge of the first panel covers the fastener notch of the second panel.

The fastener notch may be V shaped, U shaped, or other. In some embodiments, when the lower edge of the first panel is placed onto the top edge of the second panel, the bottom rear edge of the first panel abuts the top rear edge of the second panel. Similarly, in some embodiments, when the lower edge of the first panel is placed onto the top edge of the second panel, the bottom middle edge of the first panel abuts the top front edge of the second panel. In some versions, the rear face of the first panel includes a plurality of notches.

In some examples, the interlocking panel system includes a starter strip, wherein the starter strip includes a front face including a fastener notch, a rear face, a top edge wherein the top edge includes a top front edge that extends above a top rear edge, and a base edge including a drip channel, wherein when the lower edge of the second panel is placed onto the top edge of the starter strip, the bottom front edge of the second panel covers the fastener notch of the starter strip. In such an embodiment, when the lower edge of the second panel is placed onto the top edge of the starter strip, the bottom rear edge of the second panel abuts the top rear edge of the starter strip and, when the lower edge of the second panel is placed onto the top edge of the starter strip, the bottom middle edge of the second panel abuts the top front edge of the starter strip.

In some versions of the interlocking panel system, the first panel is a multilayer construction wherein an inner layer is made from waste material.

An advantage of the siding is that it is interlocking.

Another advantage of the siding is it is easy to install

A further advantage of the siding is that it provides a superior barrier surface.

Yet another advantage of the siding is there are no exposed fasteners.

Yet another advantage of the siding is all panels are the same size and consistent color.

Another advantage of the siding is maintenance free and can be installed in any climate condition.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
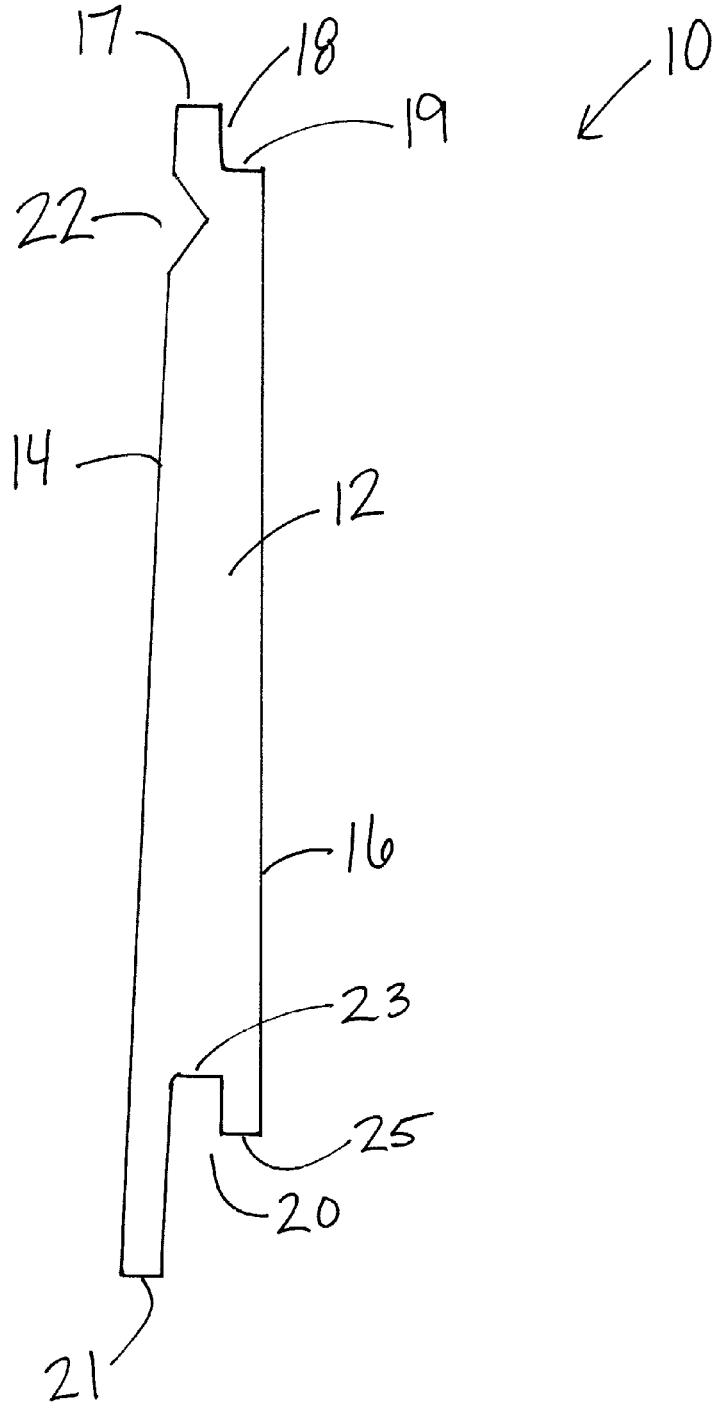
FIG. 1 is a side view of an interlocking panel.

FIG. 1 illustrates an example of an interlocking panel 10. As shown in FIG. 1, the interlocking panel includes a body 12 with a front face 14 and a rear face 16. The front face 14 is the exterior of the panel 10, which faces the elements, and the rear face 16 will be the interior of the panel 10 that faces the wall of the house, stud, sheathing, or other structure. The interlocking panel 10 includes a top edge 18 and a lower edge 20. The top edge 18 includes a top front edge 17 that extends above a top rear edge 19. The configuration of the top edge 18 allows it to connect to the lower edge 20 when the interlocking panels 10 are stacked adjacently. The lower edge 20 includes a bottom front edge 21 extending below a recessed bottom middle edge 23 and bottom rear edge 25, which falls between the bottom front edge 21 and the bottom middle edge 23. Accordingly, the top edge 18 connects by interlocking to the lower edge 20 when stacked adjacently.

Figure 11A:
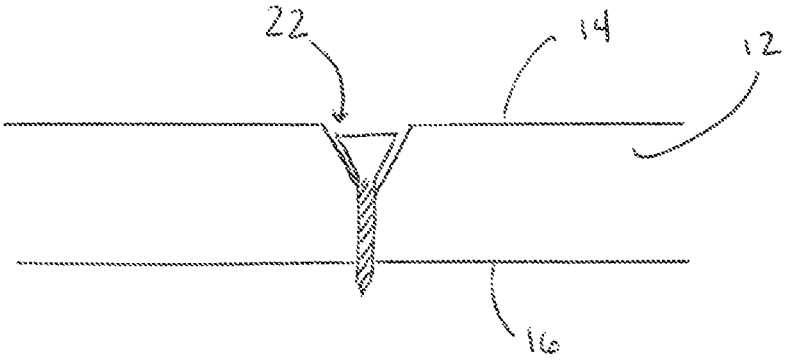
FIG. 11*a* illustrates an example of V shaped fastener notch that may be used in the interlocking panel shown in FIG. 1.
Figure 11B:
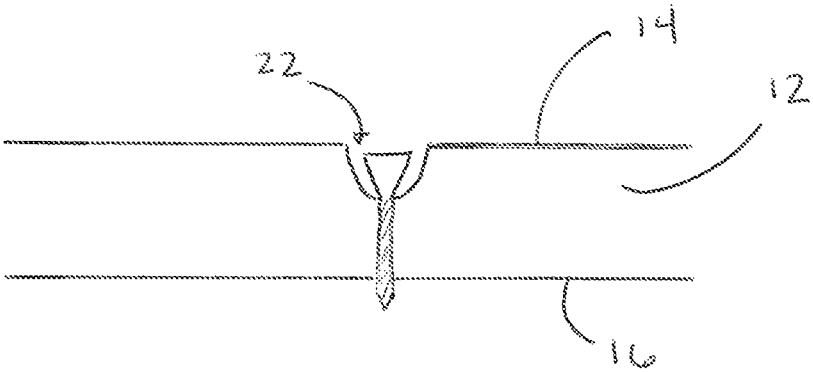
FIG. 11*b* illustrates an example of U shaped fastener notch that may be used in the interlocking panel shown in FIG. 1.

As shown in FIG. 1, the interlocking panel 10 includes a fastener notch 22. The fastener notch 22 provides placement indicia to indicate where the fasteners should be placed. When the lower edge 20 is placed on top of a corresponding top edge 18 of another plank, the front face 14 of the lower edge 20 will cover the fastener notch 22, thus covering any evidence of an opening through the panel 10 and preserving the integrity of the barrier. The fastener notch 22 may be routed in a "V" or "U" so the screw head sits slightly recessed when installed, thereby allowing the next siding panel 10 to fit together easily without catching on the screw head. In FIG. 1, the front face of the lower edge 20 extends down a considerable amount, but it is contemplated that this distance may be more or less as long as it still covers the fastener notch 22 of the next panel. Examples of fastener notches 22 are shown in FIG. 11*a* and FIG. 11*b*. However, other fastener notch 22 configurations may be used.

The interlocking panel 10 in FIG. 1 can be made out of many different materials such as wood, plastic, cement, or vinyl. It is suggested that the panels be composed of a waste material, or recycled material, to contribute to conservation and keep costs down. However, it is contemplated that in other embodiments, the interlocking panel 10 can be made of any material that is capable of providing a barrier from the elements.

Figure 2:
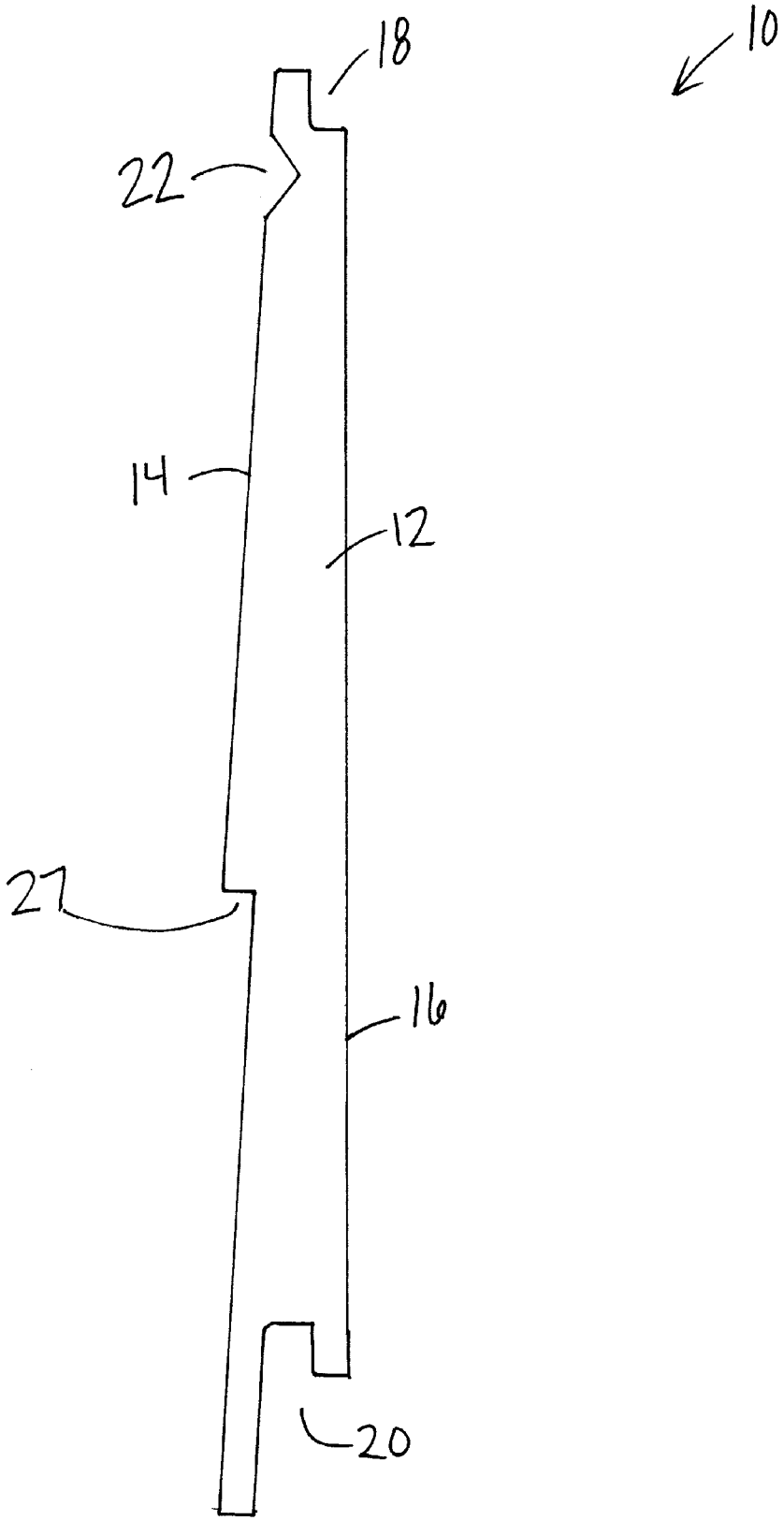
FIG. 2 is a side view of an alternative design for an interlocking panel.

FIG. 2 is an alternative design, very similar to FIG. 1 where the front face 14 includes a two-tiered profile for aesthetic value. The front face 14 includes a ridge 27 giving the panel 10 additional texture. In FIG. 2 there is one ridge 27 on the front face 14, but it is contemplated that in other embodiments, there may be any variation of ridges 27.

Figure 3:
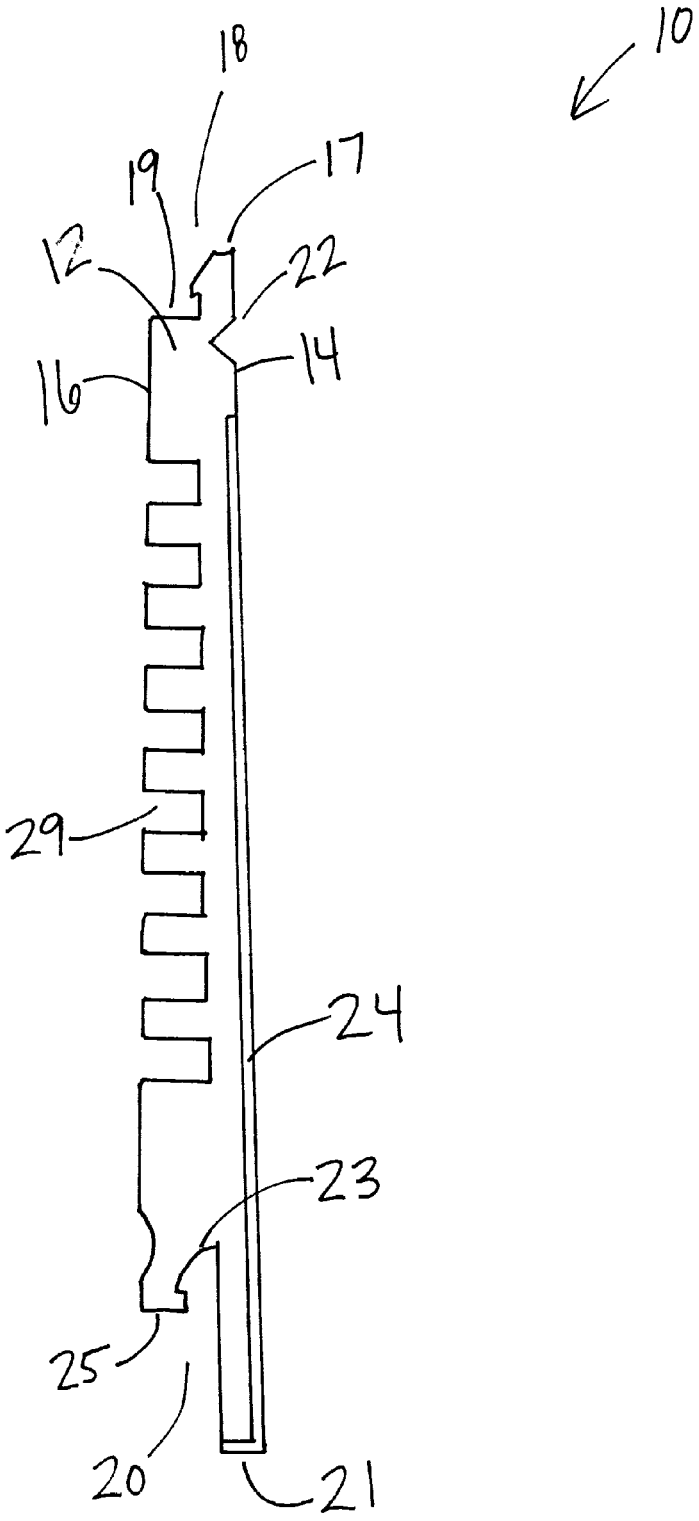
FIG. 3 is a side view of another alternative design for an interlocking panel.

FIG. 3 is another design of an interlocking panel. This variation includes a number of notches 29 on the rear face 16 to conserve the amount of material used to form the panel 10. Also, FIG. 3 contains an outside layer 24 that may be composed of a more expensive, protective, and aesthetically pleasing material, because the outside layer 24 is a thin high quality layer. Then the rest of the body 12 can be composed of a more cost efficient material.

As shown in FIG. 3, the top edge 18 and lower edge 20 are shaped differently than in the example shown in FIG. 1. In FIG. 1 the top edge 18 and lower edge 20 include squared corners to rest against each other, whereas in FIG. 3 the top edge 18 and lower edge 20 include an interlocking shape. Accordingly, the top edge 18 connects by interlocking to the lower edge 20 when stacked adjacently.

Figure 4:
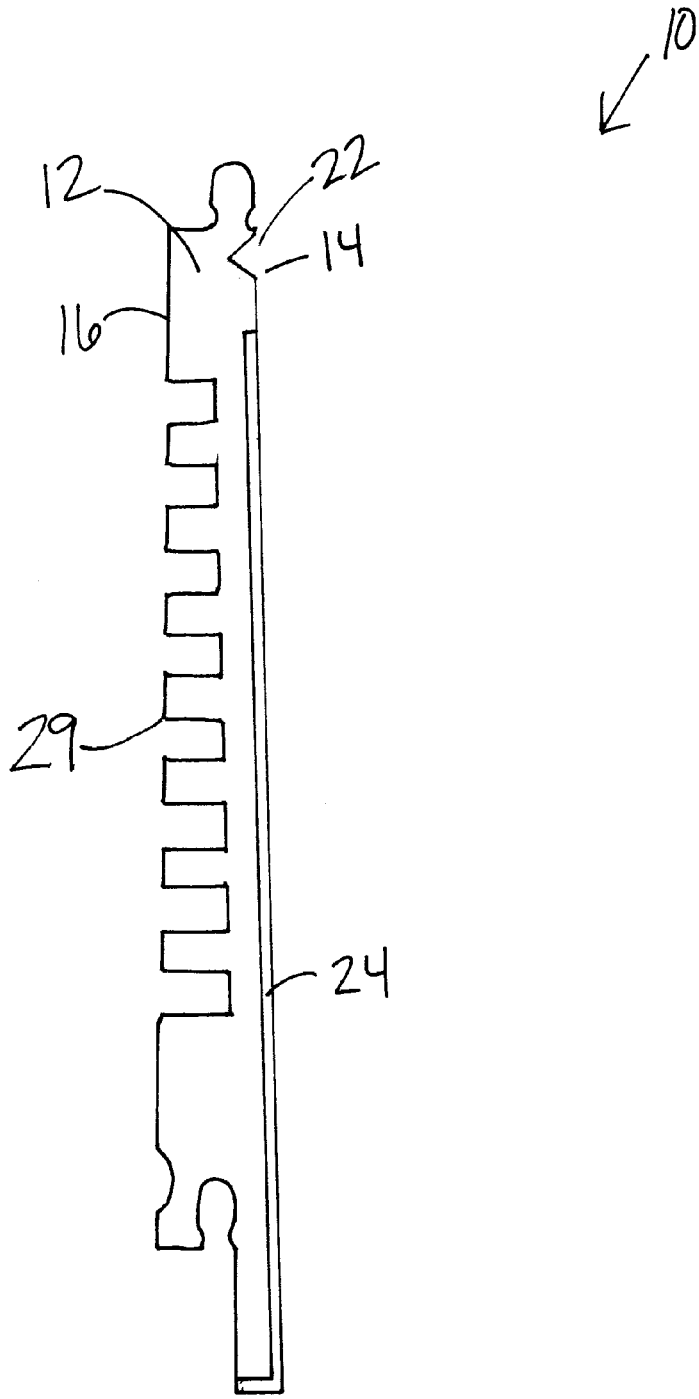
FIG. 4 is a side view of another alternative design for an interlocking panel.

FIG. 4 is yet another variation of an interlocking panel 10 that is very similar to FIG. 3. The difference between FIG. 4 and FIG. 3 is the top edge 18 and lower edge 20 profiles.

Figure 5:
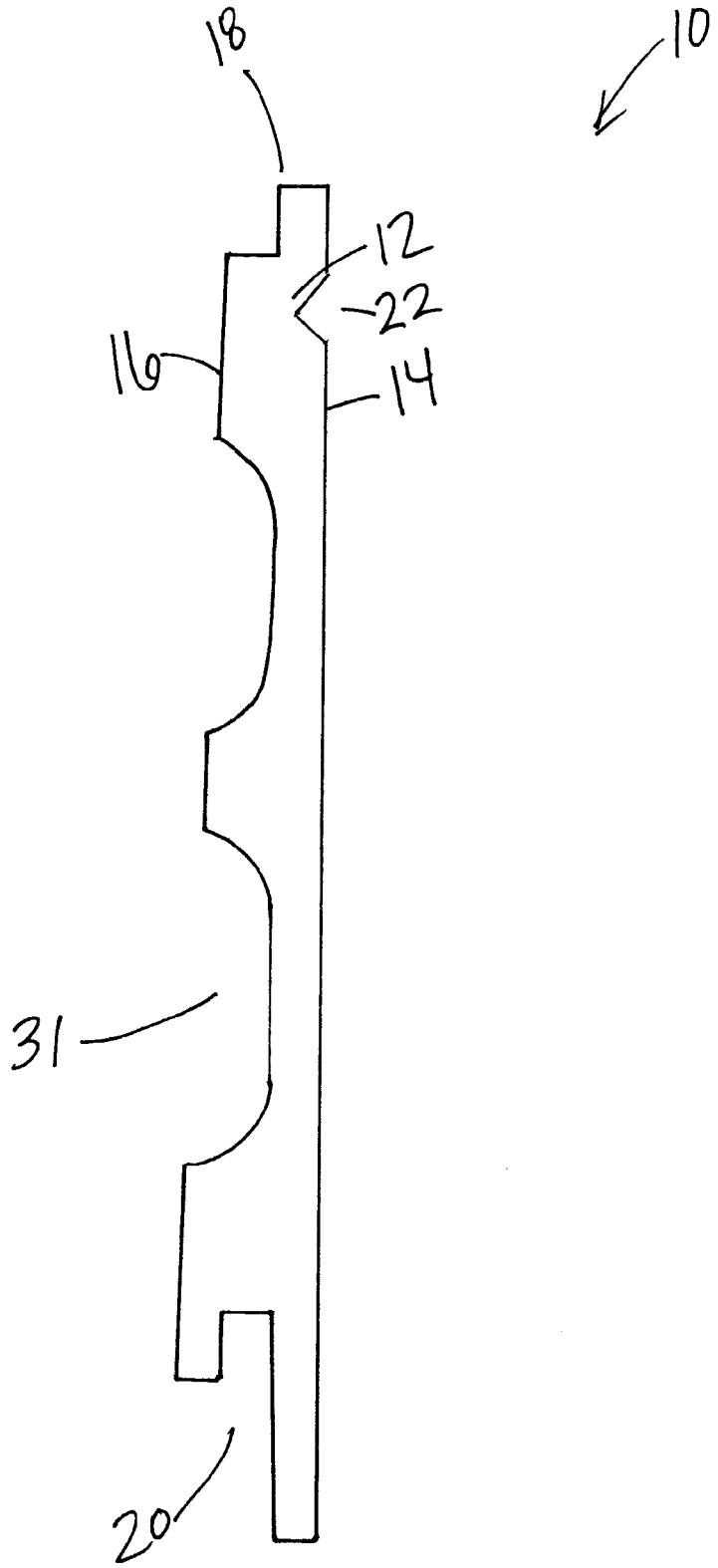
FIG. 5 is a side view of another alternative design for an interlocking panel.

FIG. 5 is another variation of an interlocking panel 10 in which there are several cut outs 31 in the body 12, thus saving on materials, and providing an alternative design. In FIG. 5 there are two cut outs in a generally oval shape, but the cut outs may be in any shape, and can be in various numbers.

Figure 6:
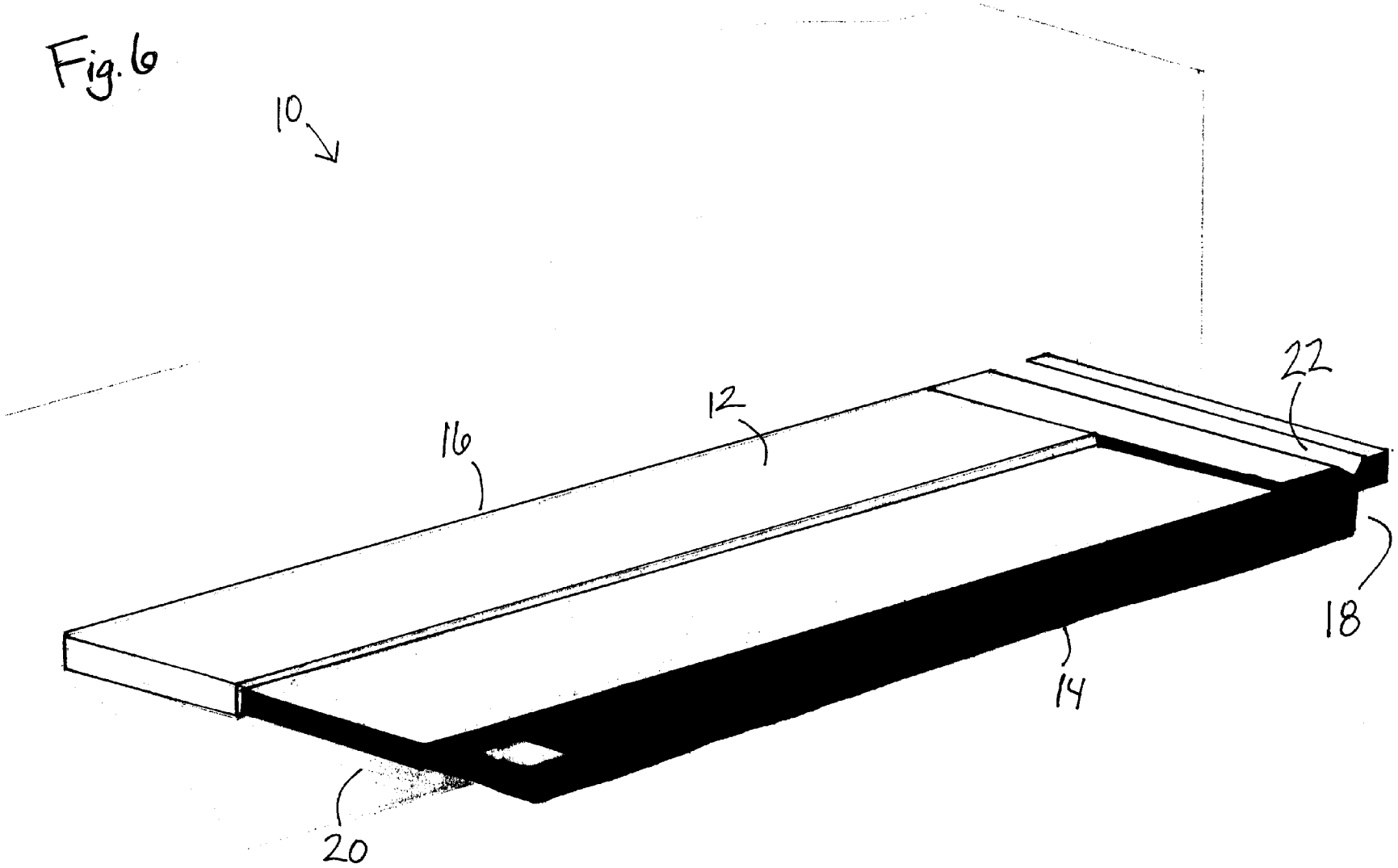
FIG. 6 is a perspective view of a body structure and the finish surface of an interlocking panel with multi-lamination.

FIG. 6 shows further how in the inner portion of the panel 10 may be composed of a different material than the outer portion. As discussed previously, the inner material may be composed of a waste material, recycled material, or any material that is more economical. The multilayer panel 10 in FIG. 6 may be formed using a multilayer extrusion process.

Figure 7:
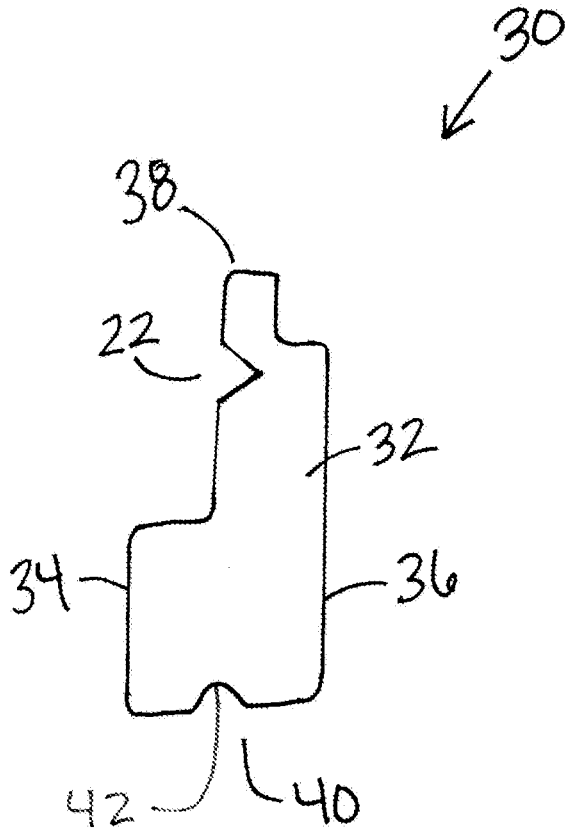
FIG. 7 is a side view of a starter strip.

FIG. 7 shows the starter strip 30 that may be used as the base upon which adjacent panels 10 may be stacked. The starter strip 30 contains a body 32 with a front face 34 and a rear face 36, similar to the panel 10. The starter strip 30 is smaller than the panels, and is sturdy enough to stabilize the first panel, so the others may follow. The starter strip 30 also contains a top edge 38 and a base edge 40. The top edge 38 will connect to the lower edge 20 or one of the first siding panels to connect to the starter strip 30. The base edge 40 will be placed at the base of the house or structure. The base edge 40 also provides a drip channel 42 to prevent water from returning to the inner structure. The top edge 38 will be shaped to correspond with the design of the panels 10.

Figure 8:
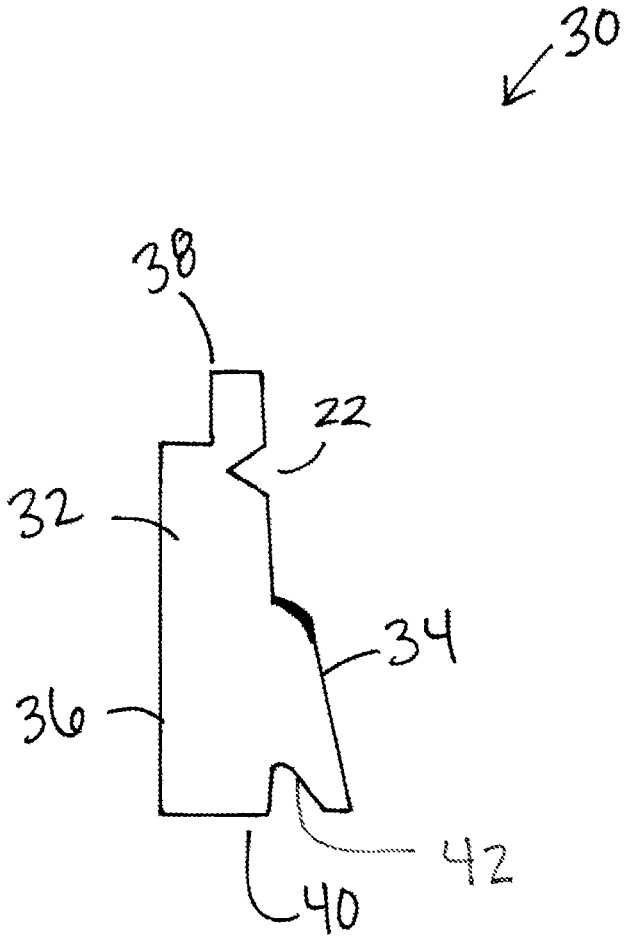
FIG. 8 is a side view of an alternative design of a starter strip.

FIG. 8 also shows a starter strip 30 that is very similar to FIG. 7. The base edge 40 in FIG. 8 is shaped slightly different than the base edge 40 in FIG. 7, in that the drip channel 42 is in a different position. It is understood that the drip channel 42 in the base edge 40 may be in any location along the base edge 40, left, right or center.

As further shown in FIGS. 7 and 8, the front face 34 may take on any of numerous profiles. Accordingly, it is contemplated that the starter strip 30 may be any shape, as long as it is adapted to integrate with the siding panels 10.

Figure 9:
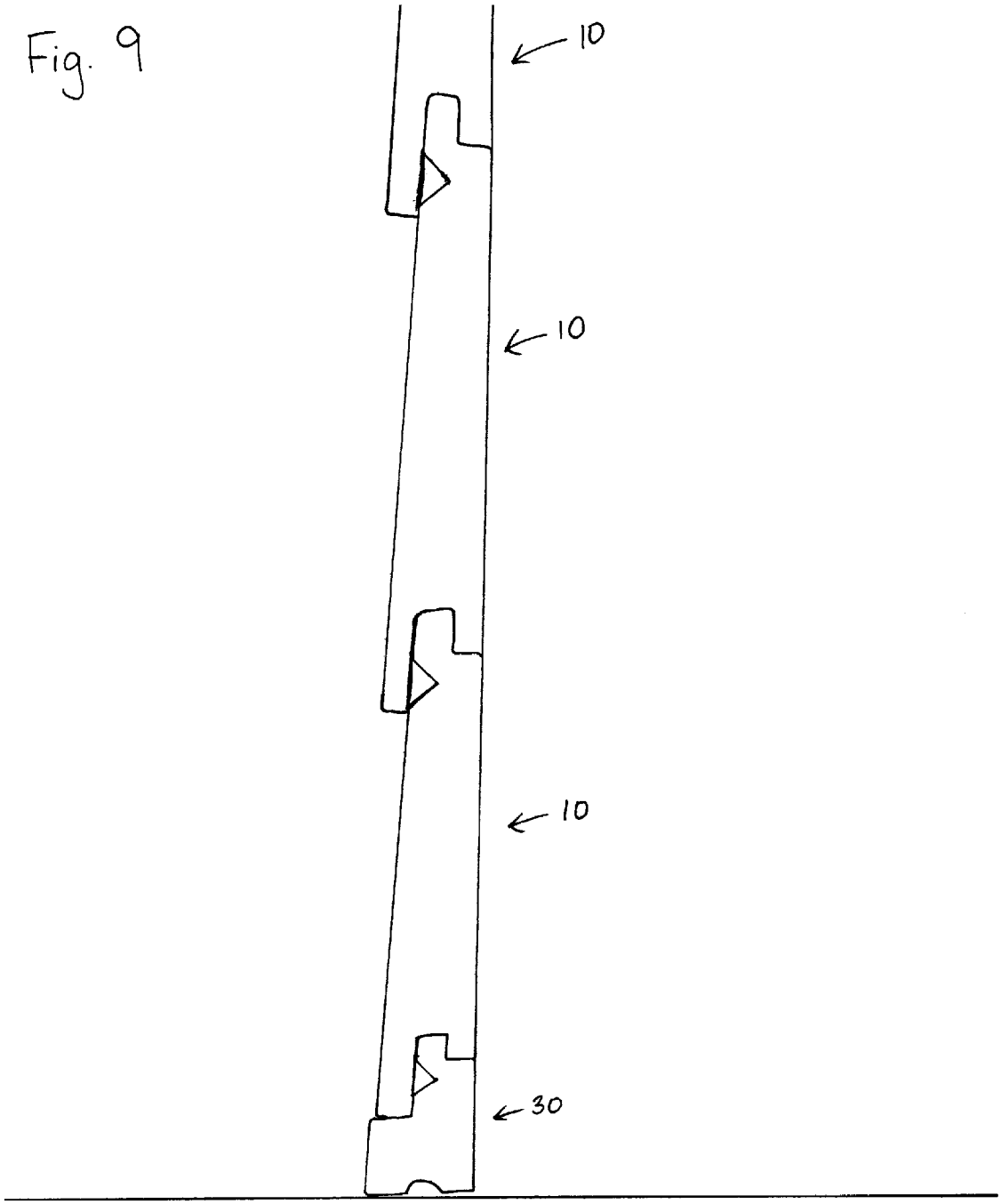
FIG. 9 is a side view of an arrangement of interlocking panels beginning with the starter strip.

FIG. 9 demonstrates how the panels 10 would fit together to form the siding, starting with the starter strip 30 at the bottom. The starter strip 30 would sit at the base of the structure, and the panels 10 would stack on top of the starter strip 30.

Figure 10:
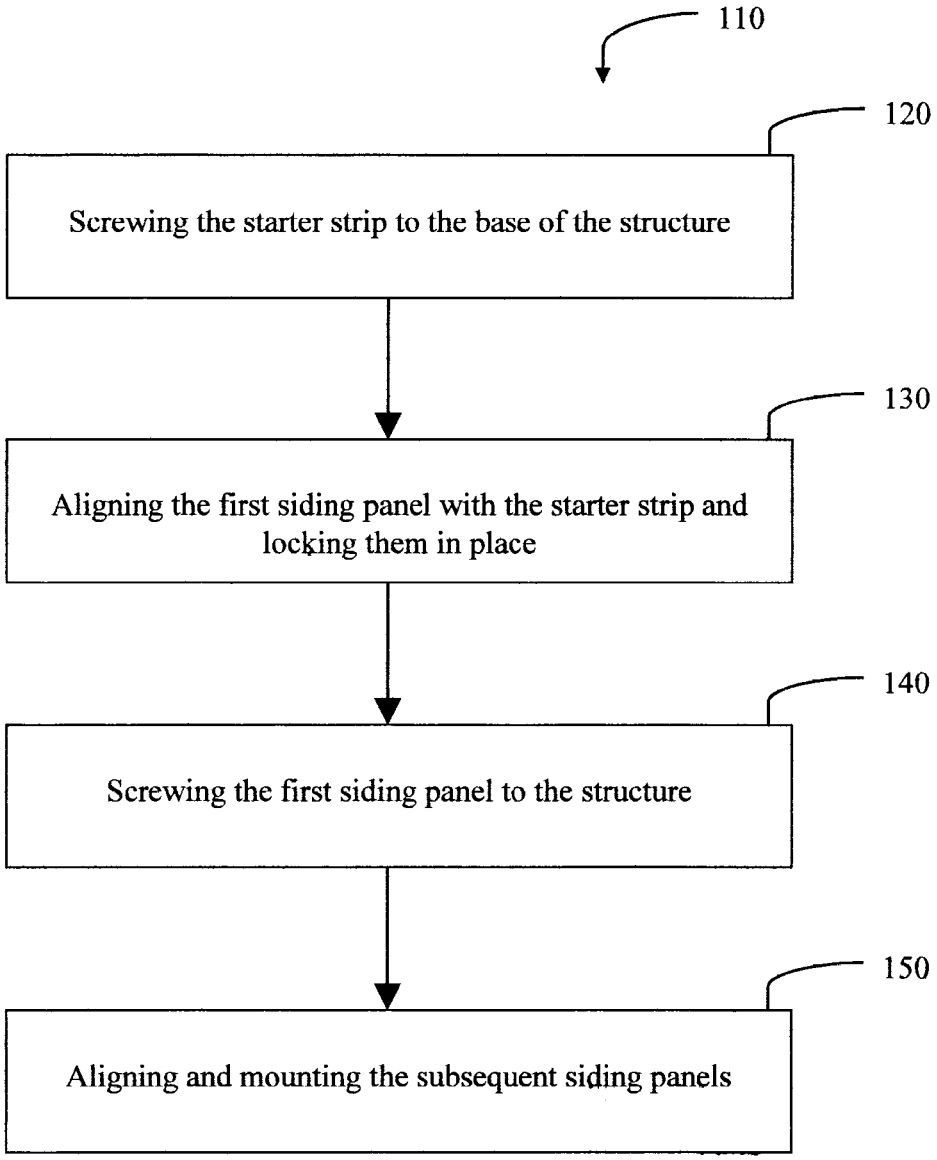
FIG. 10 is a flow chart depicting a method of installing interlocking panels and starter strip.

FIG. 10 depicts the method 110 of assembling the siding panels. The first step 120 is mounting the starter strip at the base of the structure. While the presently preferred method of mounting the starter strip at the base of the structure is by screwing the starter strip to the structure, in alternative embodiments, the starter strip may be mounted by nailing, gluing or otherwise securing the starter strip to the structure. The second step 130 is aligning the first siding panel with the starter strip and locking them in place. The starter strip and the siding panel have the corresponding notches that are meant to be locked in place and provide an effective moisture barrier. It is obvious when the starter strip and the panel are locked in place because they will lock or snap in place and fit together easily. The next step 140 is screwing the first siding panel to the structure. It is apparent to place the screws in the screw fastener notches that are indicated on the siding panels. Again, in alternate embodiments, the siding panels may be secured via other means. Once the siding panel is screwed to the structure, it is secure. The last step 150 is aligning and mounting the subsequent siding panels. The subsequent siding panels are secured just as the first siding panel was secured to the siding strip. They snap or lock into place and then are screwed to the wall or stud. In instances in which the panels do not span the width of a structure, the seams of the panels should be staggered (not aligned) to help to prevent water penetration through the siding to the substructure and butt joints (for example, 45% angle butt joints) may be provided along the seams, whereby the siding panels may be glued, caulked or otherwise adhered or sealed.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. An interlocking panel system comprising:

a first panel including:

a front face including a fastener notch;

a rear face including a plurality of laterally spanning notches;

a top edge, wherein the top edge includes a top front edge that extends above a top rear edge, wherein the top front edge is adjacent to the front face, wherein the top rear edge is adjacent to the rear face, wherein the top front edge is perpendicular to the front face, wherein the top rear edge is perpendicular to the rear face, wherein a width of the top edge is equivalent to the sum of a width of the top front edge and a width of the top rear edge; and a lower edge, wherein the lower edge includes a bottom front edge that extends below a bottom middle edge and a bottom rear edge, further wherein the bottom rear edge extends below the bottom middle edge, wherein the bottom front edge is adjacent to the front face, wherein the bottom rear edge is adjacent to the rear face, wherein the bottom front edge is perpendicular to the front face, wherein bottom rear edge is perpendicular to the rear face, wherein the bottom middle edge is perpendicular to the rear face and located at a centerline of the lower edge, wherein a width of the lower edge is equivalent to the sum of a width of the bottom front edge, a width of the bottom middle edge, and a width of the bottom rear edge, wherein the bottom middle edge is the same width as the top front edge and the bottom rear edge is the same width as the top rear edge;

a second panel including:

a front face including a fastener notch;

a rear face including a plurality of laterally spanning notches;

a top edge, wherein the top edge includes a top front edge that extends above a top rear edge, wherein the top front edge is adjacent to the front face, wherein the top rear edge is adjacent to the rear face, wherein the top front edge is perpendicular to the front face, wherein the top rear edge is perpendicular to the rear face, wherein a width of the top edge is equivalent to the sum of a width of the top front edge and a width of the top rear edge; and a lower edge, wherein the lower edge includes a bottom front edge that extends below a bottom middle edge and a bottom rear edge, further wherein the bottom rear edge extends below the bottom middle edge, wherein the bottom front edge is adjacent to the front face, wherein the bottom rear edge is adjacent to the rear face, wherein the bottom front edge is perpendicular to the front face, wherein bottom rear edge is perpendicular to the rear face, wherein the bottom middle edge is perpendicular to the rear face and located at a centerline of the lower edge, wherein a width of the lower edge is equivalent to the sum of a width of the bottom front edge, a width of the bottom middle edge, and a width of the bottom rear edge, wherein the bottom middle edge is the same width as the top front edge and the bottom rear edge is the same width as the top rear edge;

wherein, when the lower edge of the first panel is placed onto the top edge of the second panel, the bottom front edge of the first panel covers the fastener notch of the second panel; and a starter strip wherein the starter strip includes a front face including a fastener notch, a rear face, a top edge wherein the top edge includes a top front edge that extends above a top rear edge, and a base edge including a drip channel, wherein when the lower edge of the second panel is placed onto the top edge of the starter strip, the bottom front edge of the second panel covers the fastener notch of the starter strip, wherein, when the lower edge of the second panel is placed onto the top edge of the starter strip, the bottom rear edge of the second panel abuts the top rear edge of the starter strip, wherein, when the lower edge of the second panel is placed onto the top edge of the starter strip, the bottom middle edge of the second panel abuts the top front edge of the starter strip wherein the bottom middle edge of the second panel is the same width as the top front edge of the starter strip and the bottom rear edge of the second panel is the same width as the top rear edge of the starter strip.

2. The interlocking panel system of claim 1 wherein the fastener notch is V shaped.

3. The interlocking panel system of claim 1 wherein the fastener notch is U shaped.

4. The interlocking panel system of claim 1 wherein, when the lower edge of the first panel is placed onto the top edge of the second panel, the bottom rear edge of the first panel abuts the top rear edge of the second panel.

5. The interlocking panel system of claim 1 wherein, when the lower edge of the first panel is placed onto the top edge of the second panel, the bottom middle edge of the first panel abuts the top front edge of the second panel.

6. The interlocking panel system of claim 1 wherein the first panel is a multilayer construction wherein an inner layer is made from waste material.

* * * * *